US009687116B1

(12) United States Patent
Fonseca

(10) Patent No.: US 9,687,116 B1
(45) Date of Patent: Jun. 27, 2017

(54) TOOTHBRUSH HOLDER AND ORGANIZER

(71) Applicant: Jose C. Fonseca, Moline, IL (US)

(72) Inventor: Jose C. Fonseca, Moline, IL (US)

( * ) Notice: Subject to any disclaimer, the term of this patent is extended or adjusted under 35 U.S.C. 154(b) by 0 days.

(21) Appl. No.: 14/150,656

(22) Filed: Jan. 8, 2014

Related U.S. Application Data

(63) Continuation of application No. 13/363,125, filed on Jan. 31, 2012, now Pat. No. 8,651,290, which is a continuation-in-part of application No. 12/549,238, filed on Aug. 27, 2009, now abandoned.

(60) Provisional application No. 61/093,030, filed on Aug. 29, 2008.

(51) Int. Cl.
*A47B 81/02* (2006.01)
*A47K 1/09* (2006.01)
*A47F 7/00* (2006.01)

(52) U.S. Cl.
CPC ..... *A47K 1/09* (2013.01); *A47B 81/02* (2013.01); *A47F 7/0028* (2013.01); *A47F 7/0035* (2013.01)

(58) Field of Classification Search
CPC A47K 1/09; A47K 5/15; A47F 7/0021; A47F 7/0028; A47F 7/0035; A47F 7/28; B44D 3/123; B44D 3/125; B44D 3/121; A47B 81/02; A47B 81/005; A47G 29/08; A46B 17/00; A46B 17/02
USPC ..... 211/65, 13.1, 70.6, 74, 85.18, 60.1, 66, 211/196, 205, 77; 34/443; 248/110, 111, 248/113
See application file for complete search history.

(56) References Cited

U.S. PATENT DOCUMENTS

| | | | | | |
|---|---|---|---|---|---|
| 374,794 | A | * | 12/1887 | Kilmer | A47K 1/09 211/65 |
| 581,861 | A | * | 5/1897 | Hessler | A47K 1/09 206/229 |
| 1,228,261 | A | * | 5/1917 | Taylor | A47K 1/09 132/308 |
| 1,409,701 | A | * | 3/1922 | Giles | A47K 1/09 206/362.3 |
| 1,424,434 | A | * | 8/1922 | Ausubel | A47K 1/09 132/310 |
| 1,453,959 | A | * | 5/1923 | Thomas | A47K 1/09 312/206 |
| 1,460,995 | A | * | 7/1923 | Welpley | A47K 1/09 312/207 |
| 1,946,779 | A | * | 2/1934 | Conway | A47F 5/112 248/174 |

(Continued)

*Primary Examiner* — Jennifer E Novosad
(74) *Attorney, Agent, or Firm* — Zarley Law Firm, P.L.C.

(57) ABSTRACT

A device and method to organize a plurality of toothbrushes to promote sanitary toothbrush drying and storing. This device allows the user to insert a toothbrush into the holder after use. The user will align the bristles of the toothbrush so that the bristle portion of the brush is facing down and plumb relative the horizon to allow the toothbrush to air-dry. The holder can be configured with multiple receiver members to store multiple toothbrushes while preventing cross-contamination. One embodiment features a toothbrush holder affixed to a wall while a second embodiment features a freestanding toothbrush holder. This device may also incorporate a cup holder, or a loop portion with an aperture disposed therein. The base of the holder may take various shapes and sizes. The holder may be flush-mounted, or may feature a mounting offset between the mounted surface and the receiver plate to aid in securing the toothbrush.

8 Claims, 10 Drawing Sheets

(56) References Cited

Figure 1:
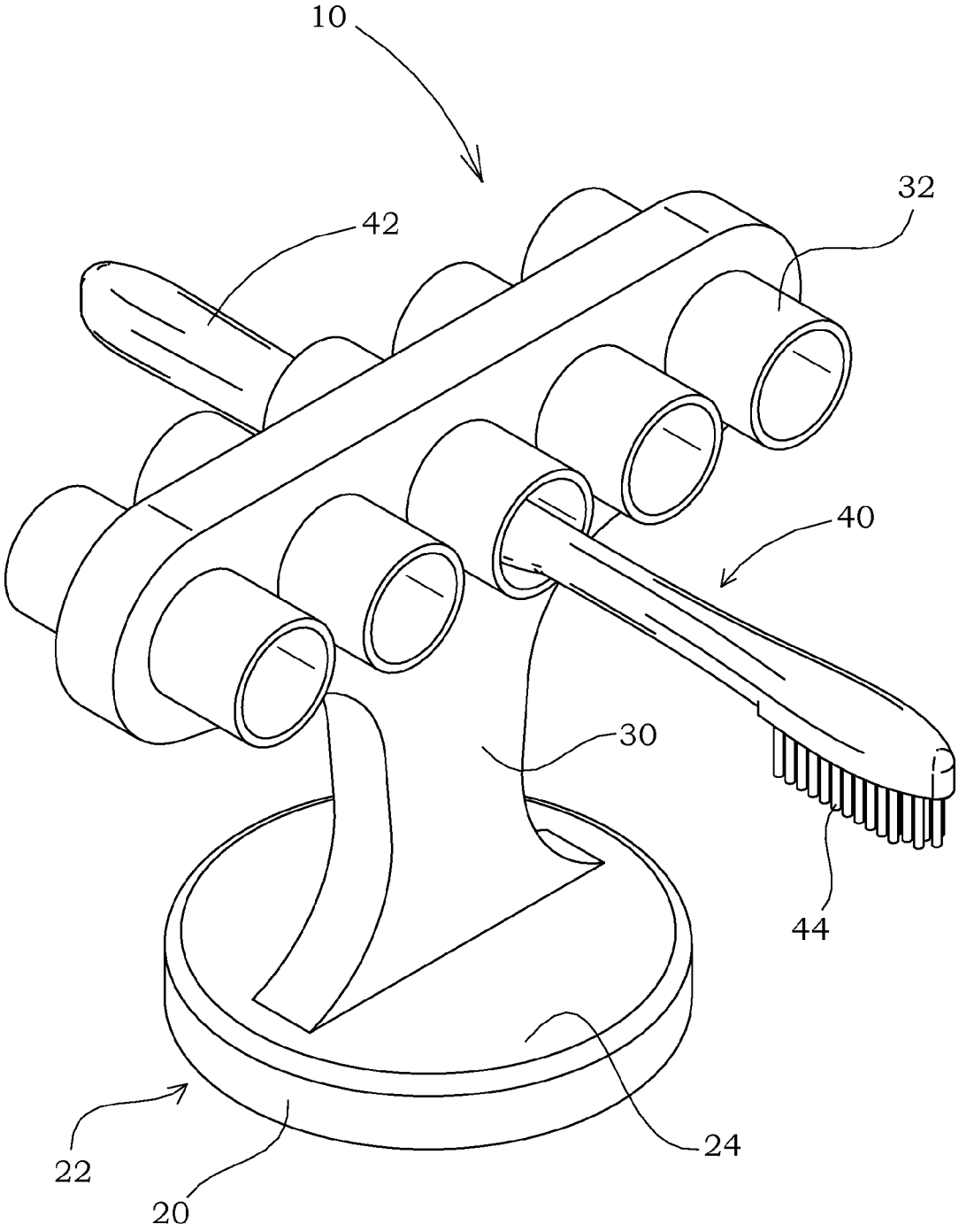

U.S. PATENT DOCUMENTS 1,954,085 A * 4/1934 McMillan ..... A47K 1/09 206/362.1
1,998,490 A * 4/1935 Carrm ..... A47F 7/285 211/14
2,032,631 A * 3/1936 Pushee ..... A47F 7/0007 211/49.1
2,150,784 A * 3/1939 Roehm ..... B44D 3/123 131/240.1
2,169,722 A * 8/1939 Currie ..... A47F 5/01 211/181.1
2,348,423 A * 5/1944 Schylander ..... A24F 19/00 131/235.1
2,576,560 A * 11/1951 Bidmon ..... A47K 1/09 206/217
2,883,992 A * 4/1959 Hastings ..... A24F 19/00 131/235.1
2,947,412 A * 8/1960 Tupper ..... A46B 17/04 15/184
3,166,193 A * 1/1965 Rex ..... A47F 7/0028 211/4
3,429,450 A * 2/1969 Lambert ..... A47B 87/02 211/60.1
3,532,222 A * 10/1970 Madden ..... B44D 3/04 211/65
4,787,514 A * 11/1988 Shepherd ..... A47F 7/283 206/427
D301,422 S * 6/1989 Schmidt ..... D19/105
4,854,457 A * 8/1989 Perler ..... A47K 1/09 211/65
4,895,260 A * 1/1990 Ancona ..... A47F 5/04 211/163
4,961,505 A * 10/1990 Moeller ..... A47F 7/0035 211/65
5,025,936 A * 6/1991 Lamoureaux ..... A47B 73/006 211/74
5,031,778 A * 7/1991 Edgecombe ..... A47F 7/00 211/26
5,085,230 A * 2/1992 Roman ..... A24F 19/14 131/235.1
D327,194 S * 6/1992 Merkel ..... D6/534
D342,585 S * 12/1993 Fischbach ..... D28/38
5,484,065 A * 1/1996 Davoli, Jr. ..... A47K 1/09 211/2
5,615,782 A * 4/1997 Choe ..... A45D 1/00 211/60.1
5,664,689 A * 9/1997 Mirlisena, Sr. ..... A47B 67/02 108/69
6,027,081 A * 2/2000 Rosenberg ..... A47J 43/287 211/65
6,102,203 A * 8/2000 Marro ..... A47K 1/09 206/362.1
6,209,732 B1 * 4/2001 Dennis ..... A45D 1/04 211/70.6
D469,926 S * 2/2003 Petruccelli ..... D28/73
D495,215 S * 8/2004 Massey, Jr. ..... D7/637
7,080,743 B1 * 7/2006 Wolseth ..... A47B 73/004 211/60.1
7,360,661 B2 * 4/2008 Nickerson ..... A47B 81/007 211/74
D590,183 S * 4/2009 Hensel ..... D6/672
8,517,187 B1 * 8/2013 Westphal ..... A47K 1/09 211/65
D691,423 S * 10/2013 Chapman ..... D7/600.2
8,651,290 B1 * 2/2014 Fonseca ..... A47K 1/09 211/65
9,210,996 B1 * 12/2015 Kramer ..... A46B 15/0095
2003/0034315 A1 * 2/2003 Tayebi ..... A47K 1/09 211/65
2003/0116516 A1 * 6/2003 Belokin ..... A47F 7/0028 211/69.5
2006/0180559 A1 * 8/2006 Roberti ..... B44D 3/12 211/65
2009/0127214 A1 * 5/2009 Kruger ..... A47B 88/20 211/65
2009/0242442 A1 * 10/2009 Kaddissi ..... A47K 1/09 206/362.3
2010/0051565 A1 * 3/2010 Fonseca ..... A47K 1/09 211/65
2015/0041417 A1 * 2/2015 Christenson ..... A47F 7/0028 211/26

* cited by examiner

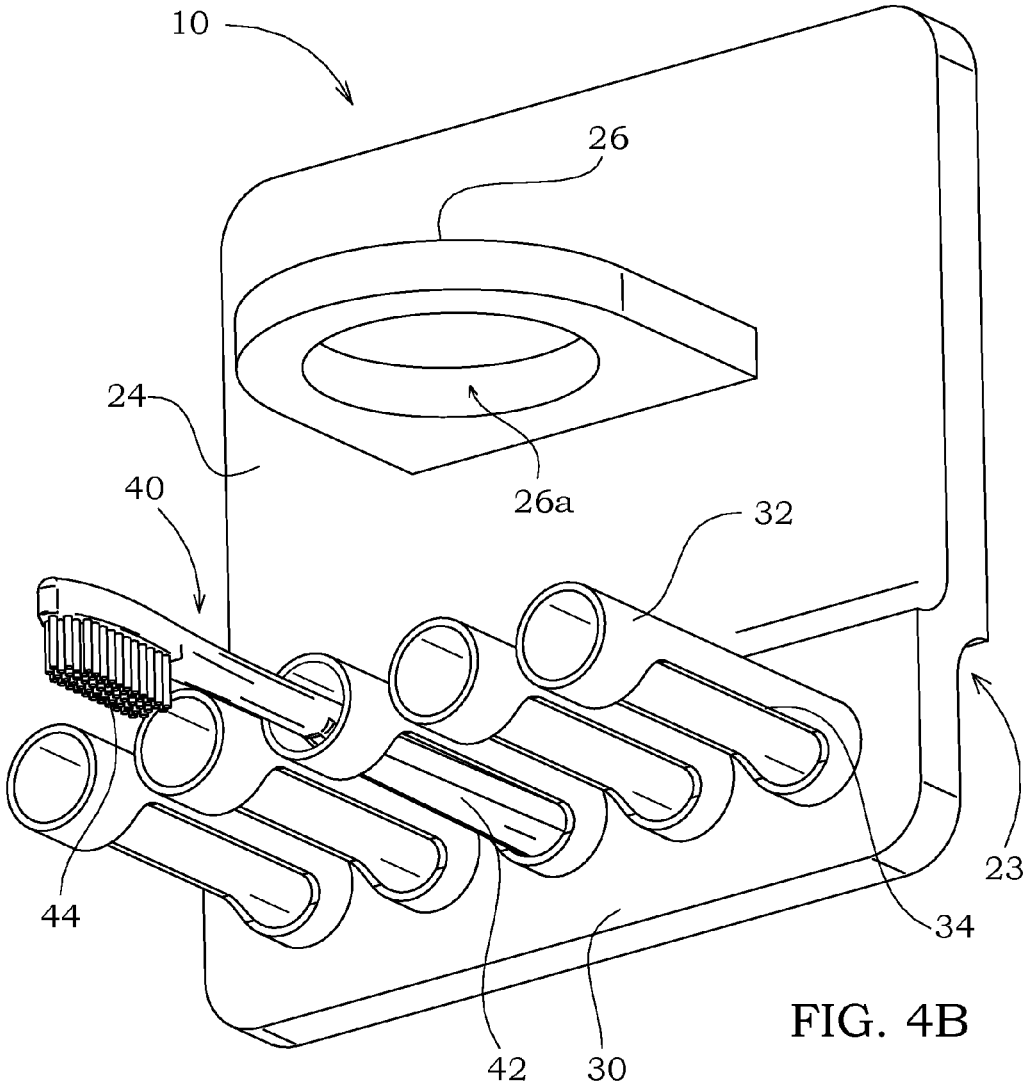
FIG. 4B
FIG. 4C
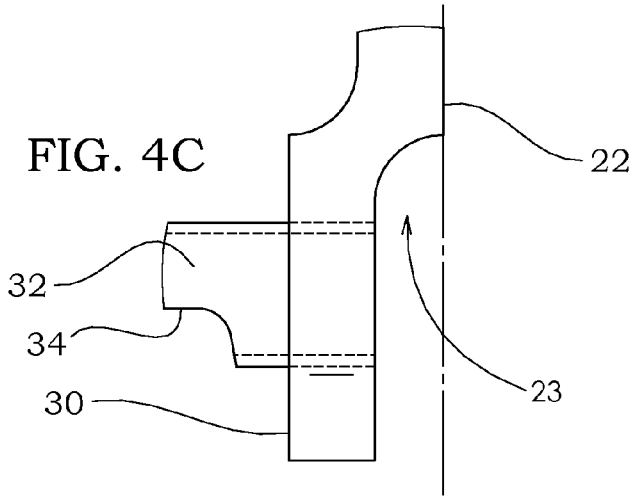

TOOTHBRUSH HOLDER AND ORGANIZER

CROSS REFERENCE TO RELATED APPLICATIONS

This application claims priority from and is a continuation of U.S. patent application Ser. No. 13/363,125 filed on Jan. 31, 2012, which was a continuation-in-part of U.S. patent application Ser. No. 12/549,238 filed on Aug. 27, 2009, which claims priority from U.S. Provisional App. No. 61/093,030 filed on Aug. 29, 2008, all of which are incorporated by reference herein in their entireties.

FIELD OF THE INVENTION

The present invention is directed to a toothbrush holder and method of using the toothbrush holder, which includes at least one receiver member mounted to a receiver plate connected to a plurality of base designs that provides support to the handle of a toothbrush to promote sanitary drying and to prevent cross-contamination amongst toothbrushes.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

DETAILED DESCRIPTION—BRIEF DESCRIPTION OF DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

FIG. 1 provides a front perspective view of a first embodiment of the toothbrush holder.

Figure 2:
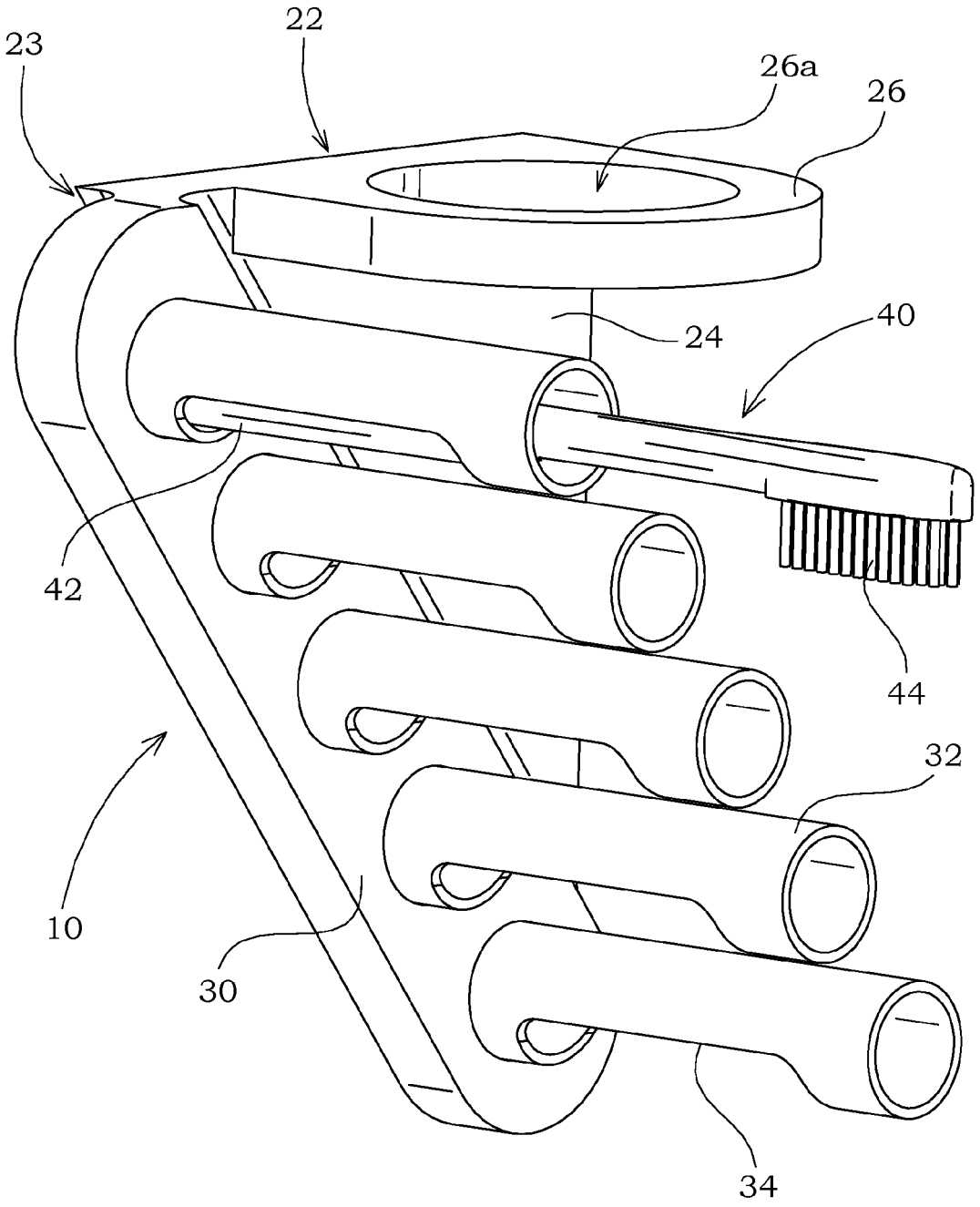

FIG. 2 provides a front perspective view of a second embodiment of the toothbrush holder.

Figure 2A:
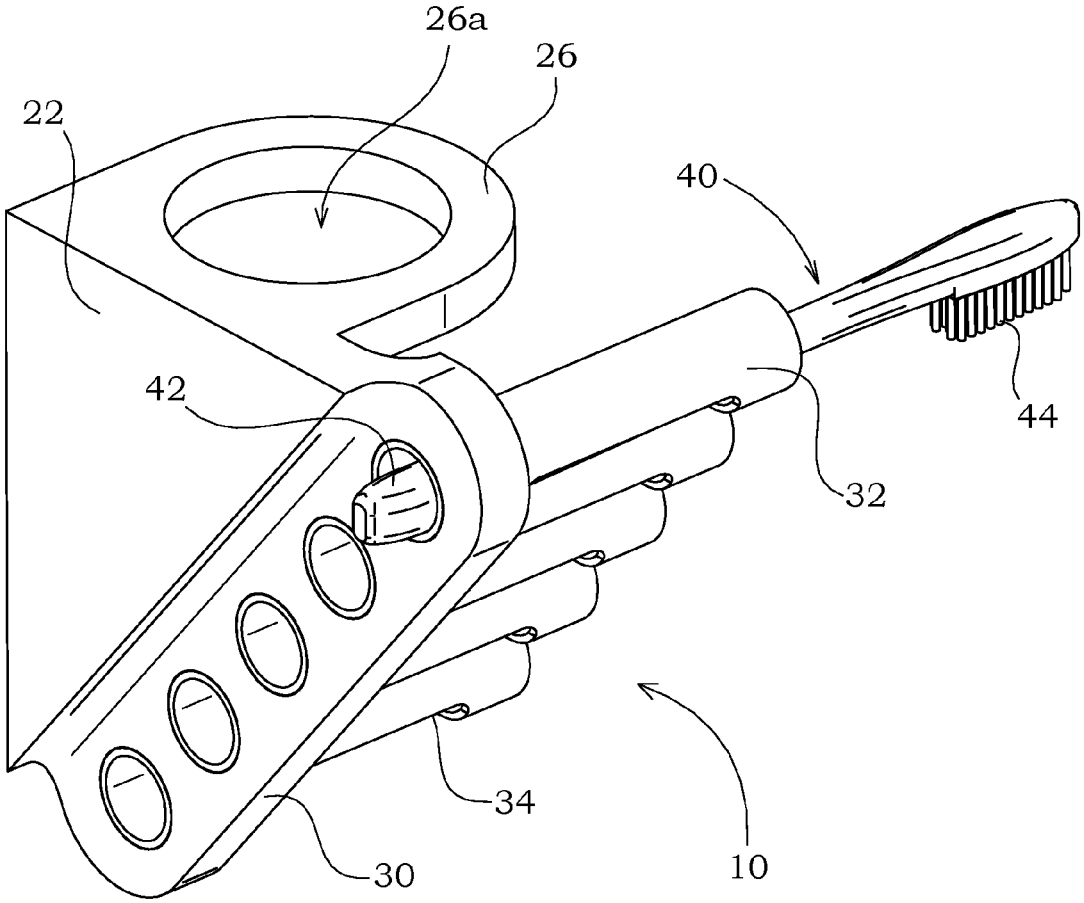

FIG. 2A provides a rear perspective view of the embodiment of FIG. 2.

Figure 2B:
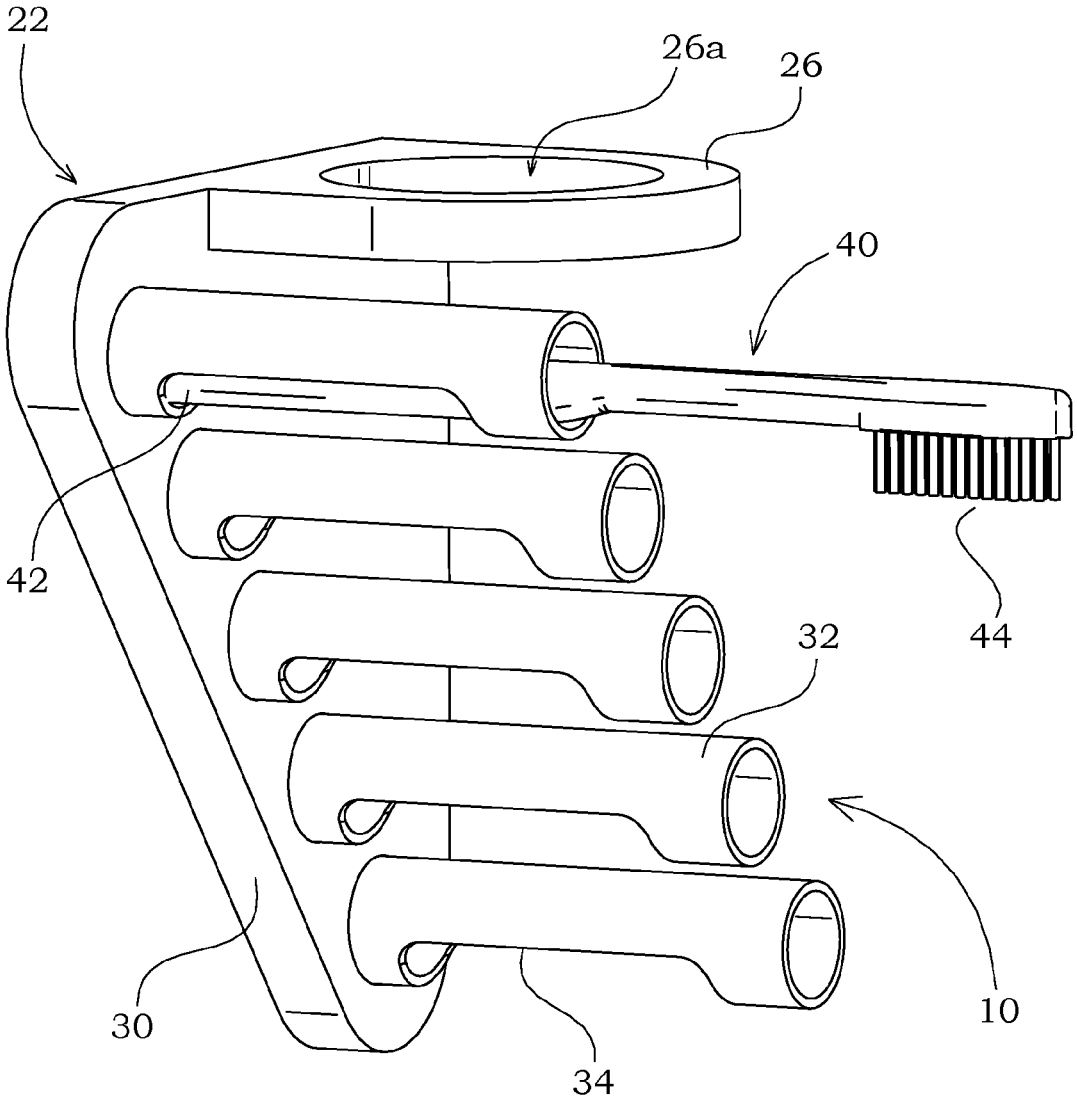

FIG. 2B provides a front perspective view of another embodiment of the embodiment depicted in FIG. 2.

Figure 3:
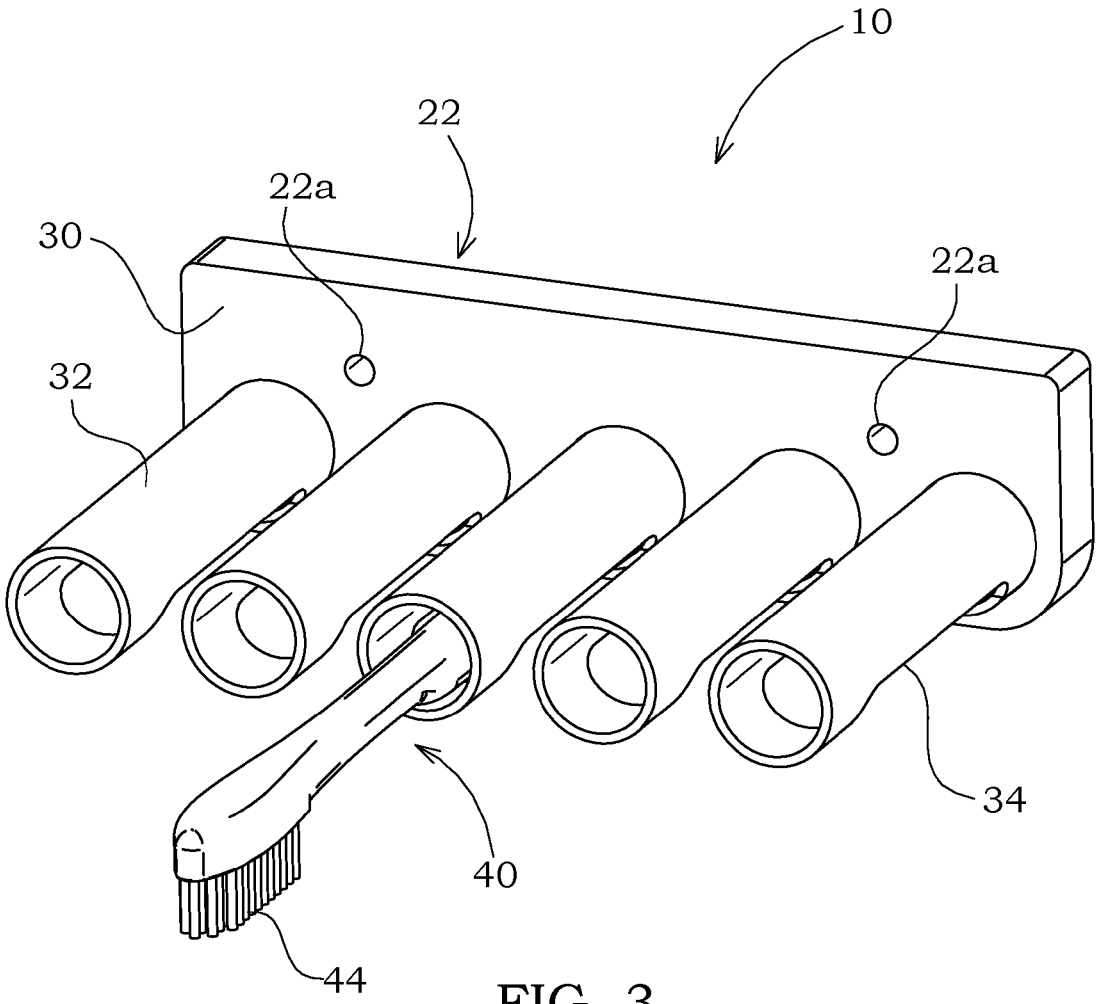

FIG. 3 provides a front perspective view of a third embodiment of the toothbrush holder.

Figure 4:
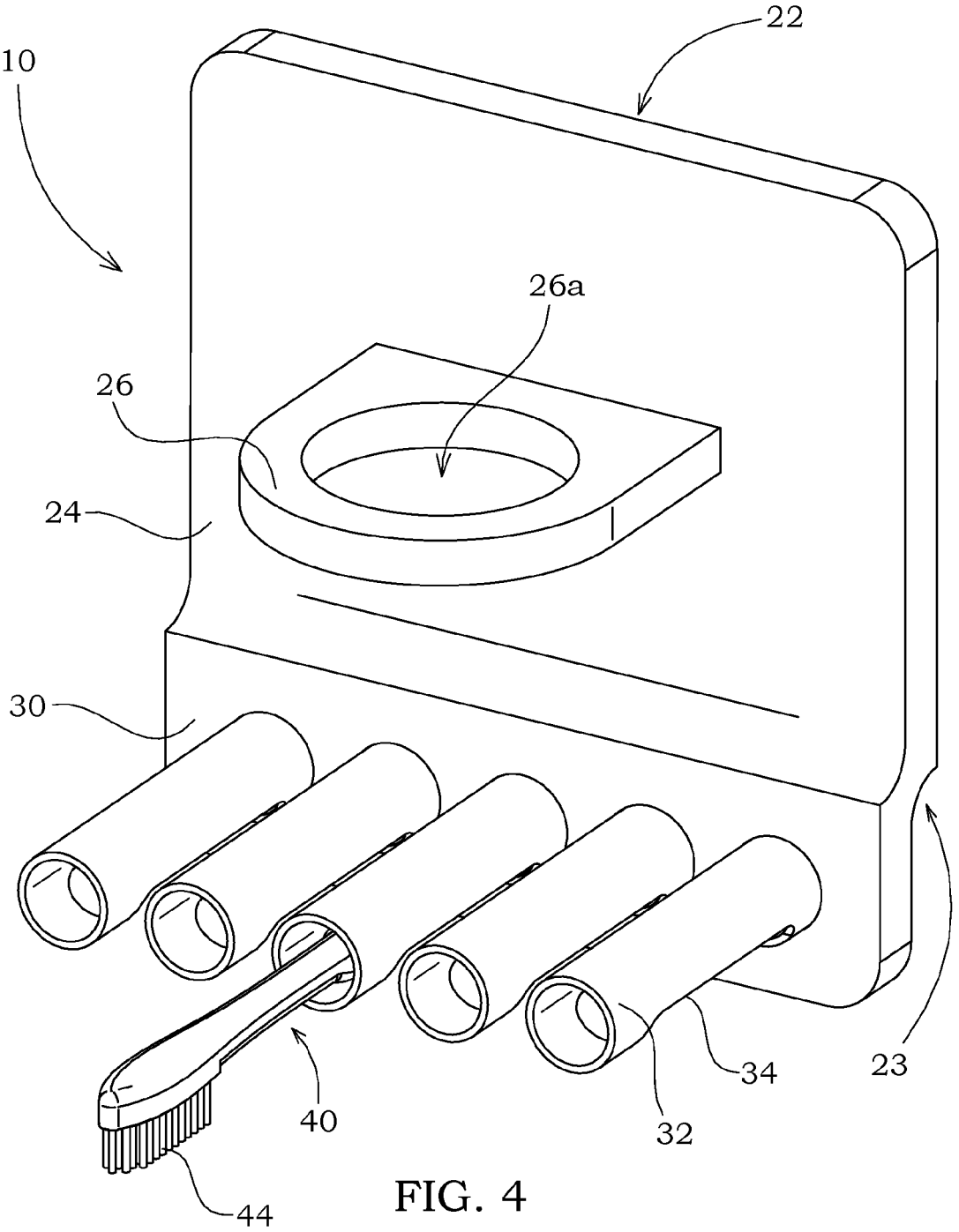

FIG. 4 provides a front perspective view of a fourth embodiment of the toothbrush holder.

Figure 4A:
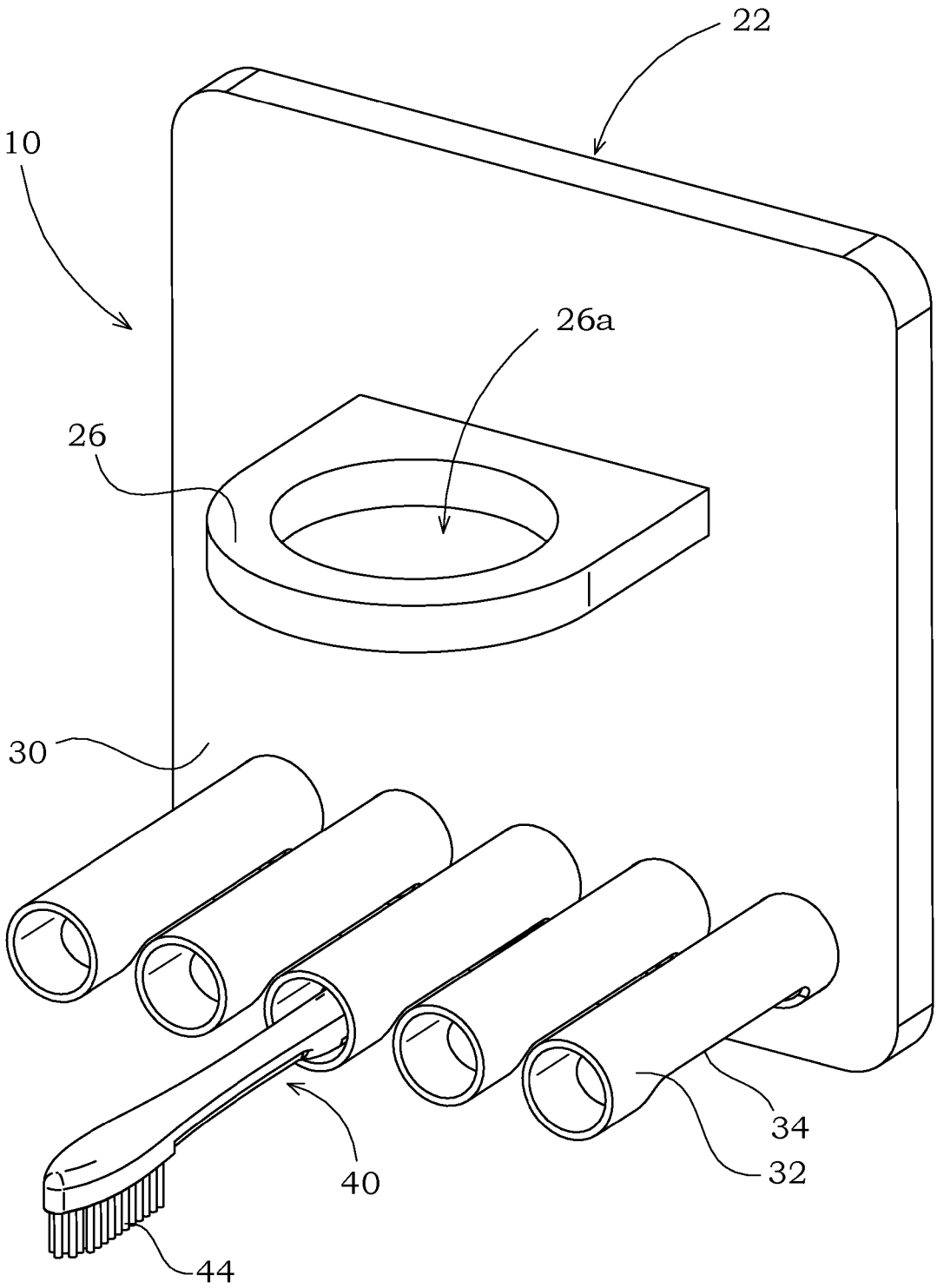

FIG. 4A provides a front perspective view of another embodiment of the toothbrush holder of FIG. 4.

FIG. 4B provides a lower front perspective view of another embodiment of the toothbrush holder of FIG. 4.

FIG. 4C provides a partial side view of the embodiment of FIG. 4B.

Figure 5:
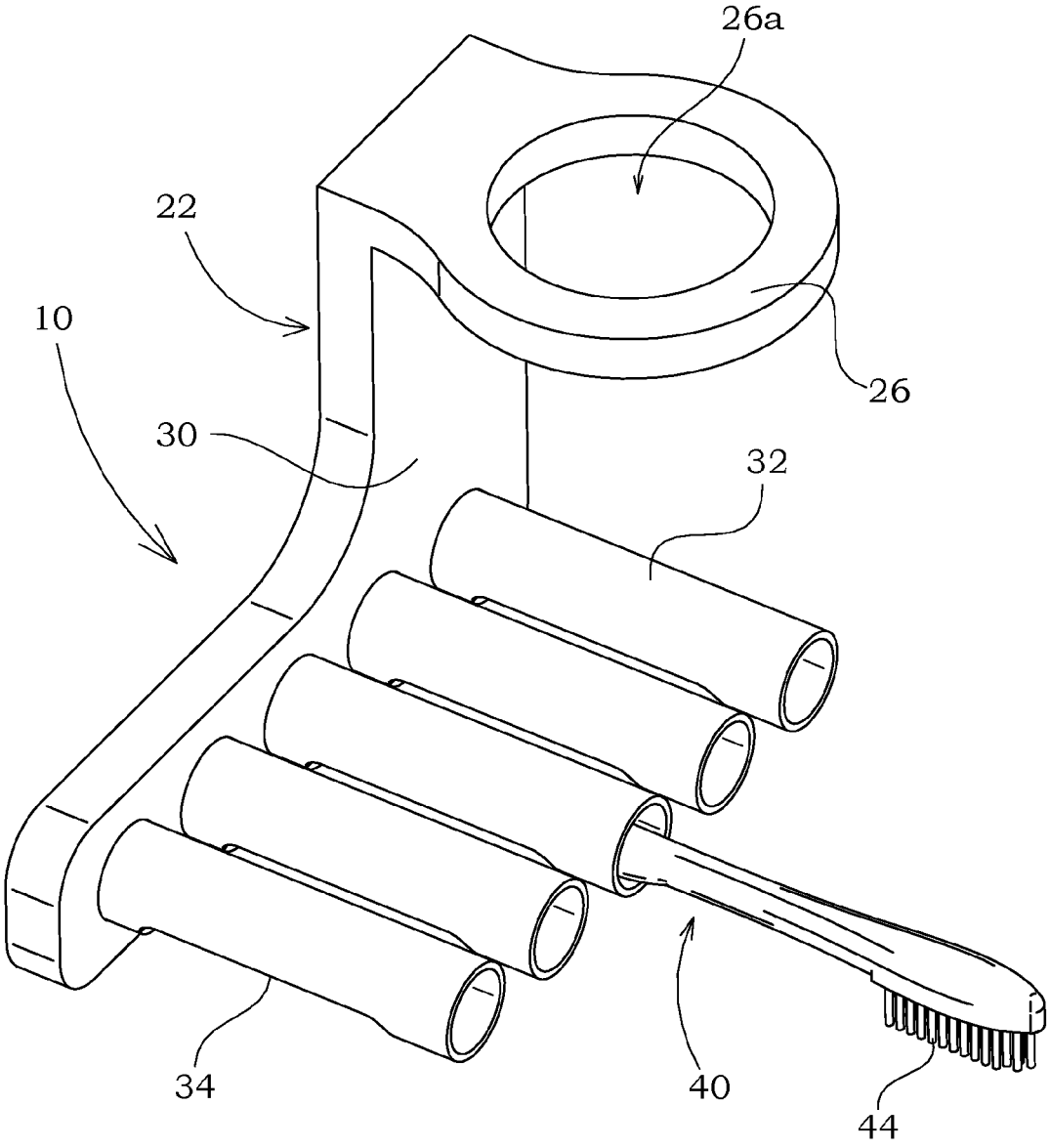

FIG. 5 provides a perspective view of a fifth embodiment of the toothbrush holder.

Figure 5A:
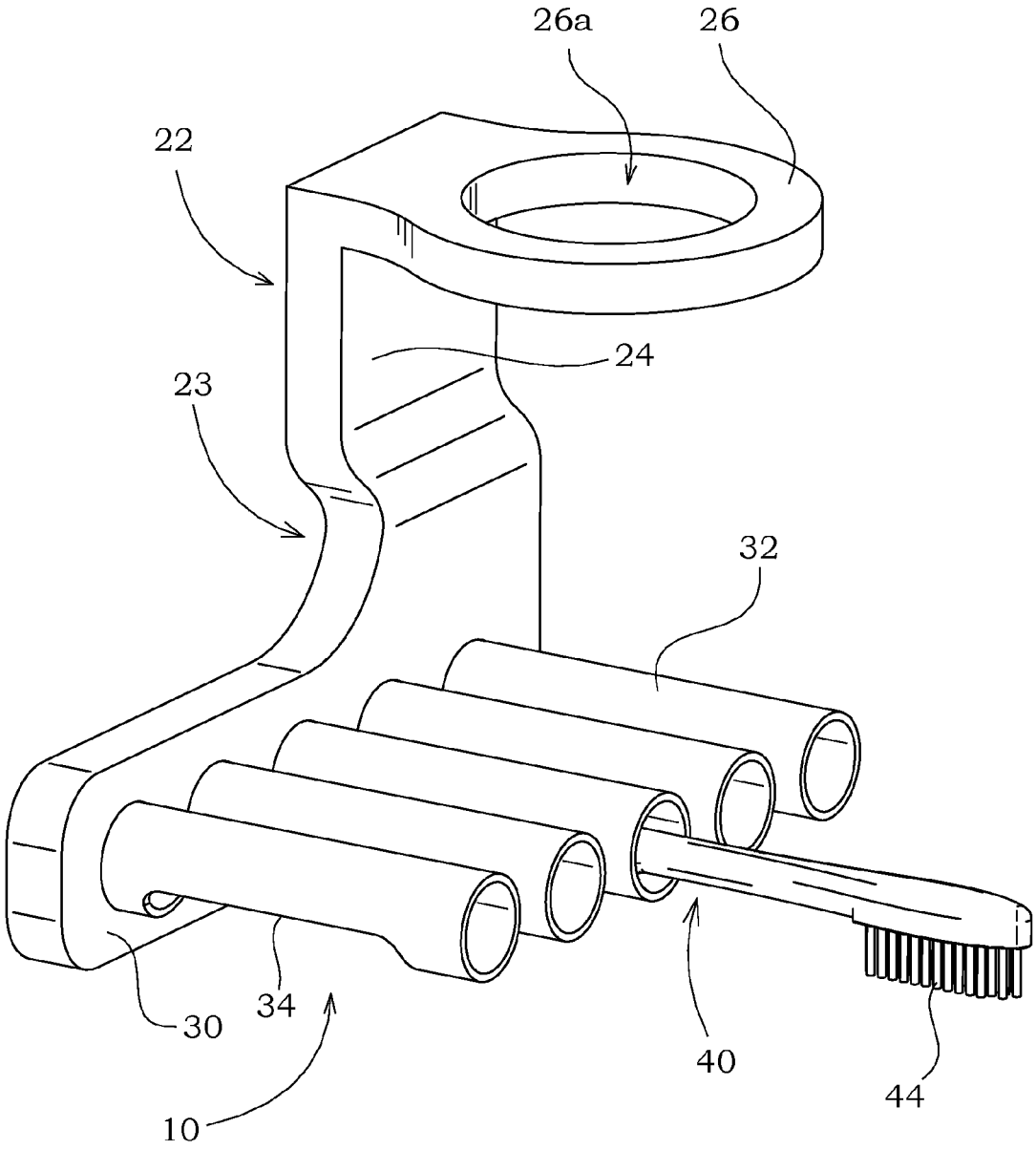

FIG. 5A provides a perspective view of another embodiment of FIG. 5.

DETAILED DESCRIPTION—LISTING OF ELEMENTS

| Element Description | Element Number |
|---|---|
| Holder | 10 |
| Base | 20 |
| Mounting Surface | 22 |
| Mounting Holes | 22a |
| Mounting Offset | 23 |
| Exterior Surface | 24 |
| Loop | 26 |
| Aperture | 26a |
| Receiver Plate | 30 |
| Receiver Member | 32 |
| Receiver Port | 34 |
| Toothbrush | 40 |
| Handle | 42 |
| Bristles | 44 |

DETAILED DESCRIPTION OF INVENTION

Before the various embodiments of the present invention are explained in detail, it is to be understood that the invention is not limited in its application to the details of construction and the arrangements of components and elements set forth in the following description or illustrated in the drawings. The invention is capable of other embodiments and of being practiced or of being carried out in various ways not explicitly disclosed herein without departing from the scope and spirit of the present invention. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below that can each be used independently of one another or in combination with other features.

Referring now to the drawings, wherein like reference numerals designate identical or corresponding parts throughout the several views, FIGS. 1-5A provide perspective views of multiple embodiments of the toothbrush holder 10. As shown in FIG. 1, one embodiment of the holder 10 features a base 20 that has a mounting surface 22 and an exterior surface 24. In this embodiment, the mounting surface 22 of the base 20 rests on a shelf, table, or countertop. The exterior surface 24 is integrally formed with the receiver plate 30. The receiver plate 30 has holes disposed within to receive the receiver members 32. The holes in the receiver plate 30 and the corresponding receiver members 32 are configured to receive multiple toothbrush handle sizes of common toothbrush molds. In FIGS. 2-5A, the receiver members 32 are configured with receiver ports 34. These receiver ports 34 are positioned interior the receiver member 32 on the basal side relative the horizon. The receiver ports 34 act to facilitate drainage of excess liquid that may collect on the interior of the receiver members 32 as well as to allow exposure to air for further drying of the interior of receiver members 32 as well as toothbrush handles 42 when positioned inside the receiver members 32. In the embodiments shown, the ports 34 have a generally curved or arched shape. Those of ordinary skill will appreciate that other configurations and designs to promote drying within the receiver members 32 are possible without departing from the teaching and claims herein.

As shown, a toothbrush 40 rests within the receiver members 32 such that the bristles 44 remain exposed. In one embodiment, the receiver members 32 are cylindrically-shaped to receive various toothbrush 40 handle 42 shapes and sizes. During use a user will position a toothbrush 40, handle 42 first, into the receiver member 32. Due to the receiver member's 32 shape, the toothbrush 40 will remain oriented in the position of entry. Therefore, if the user orients a toothbrush 40 such that the bristles 44 are pointed down, relative the horizon, then the toothbrush 40 will remain in that position until manually adjusted. This position will allow any excess water remaining on the bristles 44 of the toothbrush 40 to dry. In this embodiment one or many receiver members 32 may be disposed within the receiver plate 30. The receiver members 32 are configured to hold a toothbrush 40 in place so that when multiple toothbrushes 40 are inserted there is no cross-contamination between brush bristles 44. In this embodiment, the base 20 rests on a surface and is gravitationally held in place, but a user may move the holder 10 to any relatively flat surface for use. This embodiment may also feature a cup holder, which consists of an aperture 26*a* disposed within a loop 26 structure attached to the holder 10.

While it is shown, to construct a receiver member 32 that is primarily cylindrical, other receiver member 32 constructions are available and predicted without departing from the scope of the invention. For example, a receiver member 32 having an elliptical or triangular shape that will self-align an inserted toothbrush 40 may be used is possible. In this embodiment, one vertex of the triangle would align plumb relative the horizon. This triangular receiver member 32 would promote proper toothbrush 40 alignment —bristles 44 downward and plumb relative the horizon. (Not shown). Additionally, in this embodiment, t is known to configure a receiver member 32 such that when a toothbrush 40 is inserted into the receiver member 32, the toothbrush 40 will oscillate in place to find a position wherein the bristles 42 lie plumb relative the horizon. In other embodiments the receiver members 32 may also feature a small groove, or other guiding mechanism, such as sliding rails affixed to the interior surface of the receiver members 32, to allow for such movement to orient the bristles 44 downward and plumb relative the horizon. (Not shown)

One feature of the invention is to provide a way for toothbrushes 40 to dry in a sanitary manner. By suspending a toothbrush 40 by the handle 42, the invention promotes air-drying. The use of receiver members 32 and the receiver plate 30 allows the toothbrush 40 bristles 44 to dry without contacting surfaces thereby promoting proper drainage and drying without bristle contamination. The unique configuration of receiver members 32 within the receiver plate 30 allows a multitude of toothbrushes 40 to be used with the invention without departing from the scope. The toothbrushes 40 are spaced apart to prevent cross-contamination during storage and drying.

FIGS. 2, 2A, and 2B provide perspective views of another embodiment of the holder 10. In this embodiment, the mounting surface 22 of the base 20 is securely attached to a wall or other fixed surface. FIGS. 2 and 2A of this embodiment depict a mounting offset 23 such that the base 20 and receiver plate 30 are parallel but not coplanar. As shown, the receiver plate 30 connects with the exterior surface 24 to form a mounting offset 23 between the receiver plate 30 and a wall or other fixed surface. This allows a toothbrush 40 to be inserted into the receiver member 32 until the posterior end of the handle 42 abuts a wall or other fixed surface to more securely position the toothbrush 40. In FIG. 2B the exterior surface 24 of the base 20 is integrally formed with the receiver plate 30. In FIGS. 2-2B, a cup holder, consisting of a loop 26 and aperture 26*a* is integrally formed with the exterior surface 24 of the base 20. Although not shown, a cup holder could be affixed to the holder 10 as an appendage and not integrally formed therewith without departing from the scope of the invention. The receiver plate 30 has holes disposed therein for receiving the receiver members 32. The receiver members 32 are mounted on the receiver plate 30 to prevent the toothbrushes 16 from overlapping one another. For example, due to the angular mounting, no two toothbrushes will ever be relatively located above one another when the top of the loop 26 is positioned horizontal to the horizon. While not shown, other configurations are possible without departing from the scope of the invention. For example, it is obvious to use a receiver plate that is quarter-round, angular, zig-zagged, or any other arrangement that prevents mounting the receiver members 32 above each other when mounted. This feature prevents cross-contamination that could occur when water dripping from one toothbrush 40 comes in contact with another toothbrush 40 drying below, if the two were mounted in the same gravitational vector.

FIG. 3 shows another embodiment of the holder 10. In this embodiment, the mounting surface 22 of the base 20 is securely attached to a wall or other fixed surface. As can be seen in the drawing, the exterior surface 24 and the receiver plate 30 are integrally formed. The receiver members 32 are once again disposed within the receiver plate 30 adjacent one another in a position that prevents cross-contamination, or toothbrush 40 overlap. As shown, the base 20 features mounting holes 22*a* to connect the holder 10 to a wall or other fixed structure through the use of screws, bolts, nails, or the like. While not shown, this embodiment may also feature a cup holder integrally formed with or attached to the holder 10.

While only depicted in FIG. 3, it should be readily apparent to those skilled in the art that mounting holes 22*a* may be used across the entirety of embodiments. It should also be apparent that while mounting holes 22*a* are disclosed, similar mechanisms and methods of securing a holder 20 to a wall or fixed surface are known. For example, brackets, screws, bolt and washer assemblies, nails, adhesives, and the like are all acceptable methods of affixing the holder 10 to a wall or other fixed surface.

FIGS. 4, 4A, and 4B show another embodiment of the holder 10. FIGS. 4 and 4B of this embodiment depict a mounting offset 23 such that the base 20 and receiver plate 30 are parallel but not coplanar. As shown, the receiver plate 30 connects with the exterior surface 24 to form a mounting offset 23 between the receiver plate 30 and a wall or other fixed surface. This allows a toothbrush 40 to be inserted into the receiver member 32 until the posterior end of the handle 42 abuts a wall or other fixed surface to more securely position the toothbrush 40. By contrast, in FIG. 4A of this arrangement, the receiver plate 30 and the exterior surface 24 of the base 20 are integrally formed. As shown in FIGS. 4-4B, a cup holder, consisting of a loop 26 and aperture 26*a* disposed therein, is integrally formed with the exterior surface 24 of the base 20. While not shown, the cup holder may be attached to the holder 10 in various other ways without departing from the scope of the invention.

FIGS. 5 and 5A show another embodiment of the toothbrush holder 10. In this embodiment, the mounting surface 22 of the base 20 of the holder 10 is again securely attached to a wall or other fixed surface. As shown in FIG. 5, the exterior surface 24 and the receiver plate 30 may be integrally formed. In FIG. 5*a* the receiver plate 30 is connected to the exterior surface 24 of the base 20 to form a mounting offset 23 between the receiver plate 30 and a wall or other fixed surface. FIGS. 5 and 5A both show the use of a cup holder, consisting of a loop 26 and aperture 26*a* disposed therein, which is in no way limiting to the scope of the invention.

Method(s) of Illustrative Use

To use the holder 10, a user will place a toothbrush 40, post-use, handle 42 first into the receiver member 32 portion to allow the bristles 46 of the toothbrush 40 to remain exposed while the weight of the toothbrush 40 is supported by the receiver member 32. A user will position the toothbrush 40 such that the bristles 44 rest downward and plumb relative the horizon. This alignment allows any water remaining on the bristles 44 of the toothbrush 40 to drip off the toothbrush 40.

Shown in FIGS. 2, 2B, 4, 4B, and 5A a user will insert a toothbrush 40, post-use, handle 42 first into the receiver member 32 and passed the receiver plate 30. In this embodiment, the user will insert the toothbrush 40 until the posterior end, the end opposite the bristles, contacts the wall or other fixed surface the holder 10 is mounted to.

One embodiment allows for the insertion of multiple toothbrushes 40 via multiple receiver members 32 disposed within the receiver plate 30. The receiver members 32 are arranged on the receiver plate 30 such that the toothbrushes 40 when inserted into the receiver members 32 do not overlap one another. This innovative feature allows the toothbrushes 40 to be easily stored, organized, and maintained in a sanitary fashion.

As one of ordinary skill will appreciate, the holder 10 may be manufactured from, or constructed out of wood, plastics, composites, metals, metal alloys, wax or plastic coated cardboard, or other similar materials. The holder 10 may be manufactured in various sizes and shapes to accommodate different brush arrangements and mounting configurations without departing from the scope of this invention. The arrangements, dimensions, and materials identified herein are used solely for illustrative purposes and in no way limit the scope of the invention.

It should be noted that the present invention is not limited to the specific embodiments pictured and described herein, but is intended to apply to all similar methods and apparatuses for drying and arranging toothbrushes in a sanitary manner. Accordingly, modifications and alterations from the described embodiments will occur to those skilled in the art without departure from the spirit and scope of the present invention.

What is claimed:

1. A holder of toothbrushes comprising:

a) a base having a lower mounting surface and an upper exterior surface, wherein the base is cylindrical in shape;

b) a single receiver plate connected to and extending vertically from the upper exterior surface of the base;

c) a single row of a plurality of receiver members positioned in the upper portion of the receiver plate, wherein each receiver member of the plurality of receiver members is defined by a first opening located at a first end and a second opening located at a second end, wherein the plurality of receiver members are adapted for insertion of a plurality of toothbrushes; and d) wherein each of the receiver members of the plurality of receiver members are adjacently positioned and co-planar.

2. The holder of toothbrushes according to claim 1 wherein the plurality of receiver members are positioned relative one another such that any water dripping from any one of the plurality of toothbrushes will not contact any of the other toothbrushes.

3. The holder of toothbrushes according to claim 1 wherein the receiver plate is integrally formed with the base.

4. The holder of toothbrushes according to claim 1 wherein the receiver member is integrally formed with the receiver plate.

5. The holder of toothbrushes according to claim 1 wherein the receiver member, the receiver plate and the base are integrally formed.

6. The holder of toothbrushes according to claim 1 wherein the mounting surface of the base is adapted to fixedly engage a surface.

7. The holder of toothbrushes according to claim 1 wherein the mounting surface of the base is adapted to removably engage a surface such that the toothbrush holder is detachable.

8. The holder of toothbrushes according to claim 1 wherein the receiver member gravitationally positions the handle of an inserted toothbrush such that the bristles rest at plumb relative to the horizon.

* * * * *